United States Patent [19]

Yang

[11] 4,414,025

[45] Nov. 8, 1983

[54] PROCESS FOR ADDITION OF SILICON TO IRON

[75] Inventor: Chi-Ming Yang, Kaohsiung, Taiwan

[73] Assignee: China Steel Corporation, Kaohsiung, Taiwan

[21] Appl. No.: 400,183

[22] Filed: Jul. 20, 1982

[51] Int. Cl.[3] ..... C22C 33/00

[52] U.S. Cl. ..... 75/129; 75/51; 75/52; 75/53

[58] Field of Search ..... 75/51–53, 75/58, 129, 130 R

[56] References Cited

U.S. PATENT DOCUMENTS

| | | | |
|---|---|---|---|
| 3,598,570 | 8/1971 | Otani | 75/52 |
| 3,955,966 | 5/1976 | Meichsner | 75/53 |
| 3,998,625 | 12/1976 | Koros | 75/53 |

*Primary Examiner*—P. D. Rosenberg

*Attorney, Agent, or Firm*—Ladas & Parry

[57] ABSTRACT

Ferro-silicon powder after pulverzation to a predetermined grain size is injected, preferably by a pneumatic medium, into molten iron to increase its silicon content, either alone or prior to a desulfurization treatment to make foundry pig iron with a low sulfur content.

10 Claims, 3 Drawing Figures

PROCESS FOR ADDITION OF SILICON TO IRON

The present invention relates to a process for the addition of silicon to iron.

Ferro-silicon has been added to molten iron, for example iron from a blast furnace, to adjust the silicon content, but difficulties have been found in ensuring controlled addition and homogeneous dispersion.

According to the present invention there is provided a process for the addition of ferro-silicon to iron in which ferro-silicon is pulverised to a predetermined particle size and the pulverised ferro-silicon powder is injected into molten iron.

Preferably the powder is injected by combining the powder with an gas stream which is injected into the iron. The gas stream can be nitrogen, dried compressed air, argon, carbon dioxide or a mixture of any of these gases. After addition of the ferro-silicon is completed the injection of gas can be continued to provide greater homogeneity. The molten iron can be contained in a torpedo ladle or open ladle or other type of ladle customarily used for the conveying of molten iron.

The process can be carried out in a location close to the blast furnace in which the iron is produced or at other stages prior to a steel making shop or before a location where for the iron is cast into pig iron. The process can also be carried out near the cupola. The process can be combined with desulfurization process as hereinafter described.

The process of invention has the advantages that it can be automted to considerable extent so that the addition of ferro-silicon can be readily controlled from a central point and the amounts of silicon required can be readily controlled. A system of addition via injection by a gas stream results in a good working environment. As compared to addition of ferro-silicon at the iron runner of a blast furnace a higher silicon yield is obtained by the process of invention and it is easier to obtain homogeneous pig iron. The addition has no influence in any other chemical components in the molten iron since the injection is a simple reaction in that ferro-silicon powder is added and melted and diffused in the molten iron particularly by nitrogen stirring.

Additionally homogeneity is readily obtained either by additional stirring through nitrogen blowing after completion addition of ferro-silicon or by a succeeding desulfurization treatment. The addition of ferro-silicon and desulfurization can be readily provided at the same point and the desulfurization can be easily controlled by analogous technique and to those of addition of ferro-silicon.

Preferably the ferro-silicon powder is pulverised to have a particle size under 3 mm. Most suitably the ferro-silicon used contains from 50 to 80% by weight silicon. In a particular process a pulverised ferro-silicon powder the silicon content of which is 72% by weight is employed in an amount of from 1.46 kg to 1.74 Kg per metric ton of molten iron to increase the silicon content of the iron by 0.1% by weight.

The invention is illustrated in the accompanying drawings, in which.

Figure 1:
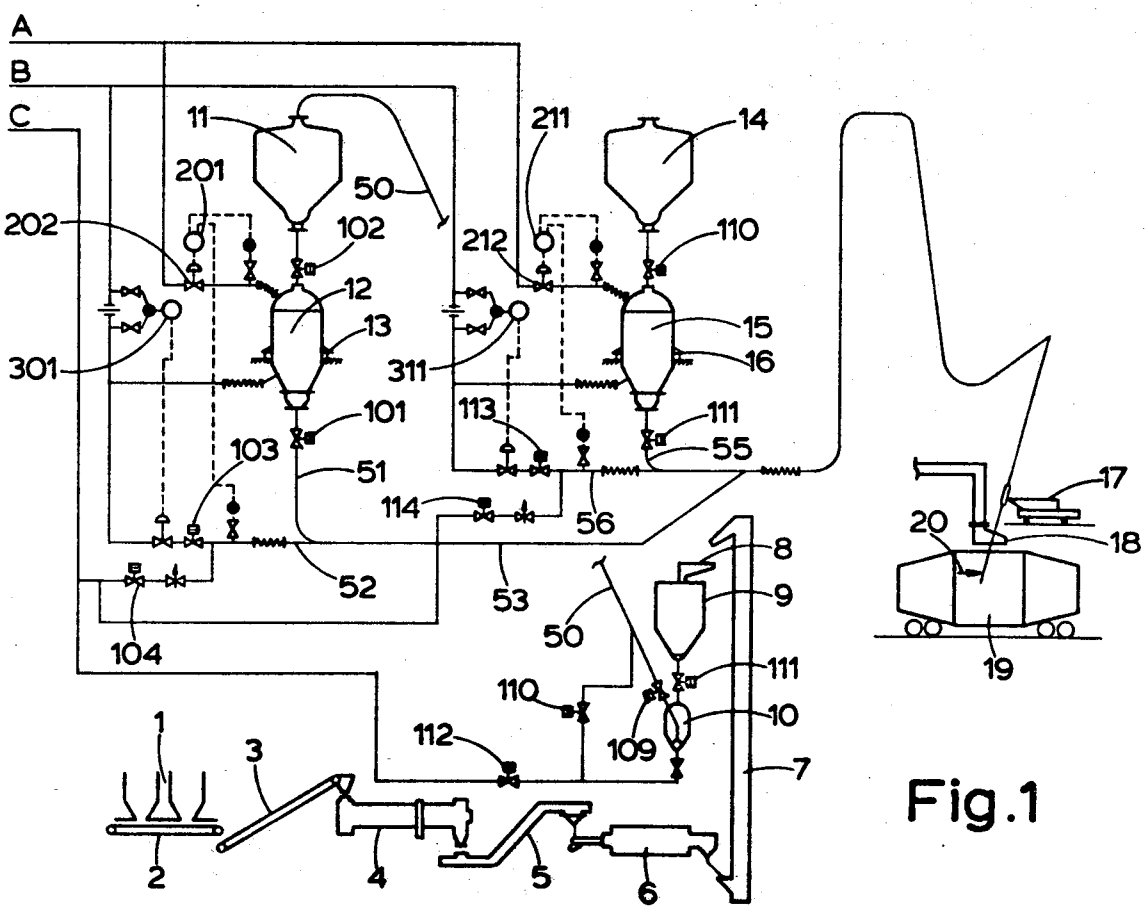
FIG. 1 is a flow chart for the manufacture and injection of ferro-silicon powder followed by desulfurization.

As illustrated in FIG. 1, a system is provided for the manufacture of ferro-silicon powder comprising a storage hopper 1 for ferro-silicon which feeds a belt conveyor 2 which in turn feeds to an inclined belt conveyor 3. This charges a rotary drier 4 from which ferro-silicon is fed to a transporting conveyor 5 which leads to the entry for charging into ball mill 6. The powder from the ball mill is transported by a bucket elevator 7 to screen 8 where it is passed to storage bunker 9.

Thus a ferro-silicon with silicon content 72% is supplied to the storage hopper 1. After drying in rotary drier 4 the moisture content is under 1.5% by weight. The ferro-silicon is milled in the ball mill 6 to a particle size of under 3 mm. If the initial moisture content of the ferro-silicon as supplied is under 1.5%, it can of course be supplied directly to the ball mill.

Where the ferro-silicon powder manufacture is close to the point of intended use, it can be conveyed directly from the storage bunker 9 to a silo 11, for example pneumatically. Thus utilising nitrogen under pressure of 4 to 5.5 $Kg/Cm^2$ from line C ferro-silicon powder is charged to a lift tank 10 through air cylinder valve 111 from the bunker 9. The lift tank 10 is pressurised with nitrogen from line C at 4 to 5.5 $Kg/Cm^2$ and by sequential operation of air cylinder valves 112, 109 and 110 the ferro-silicon powder is conveyed through line 50 to silo 11. The pressure required for conveyance of the powder from the lift tank to the silo depends on the particle size of the ferro-silicon powder, the sizing and routing of the pipe 50 for conveying the powder and the distance through which it must be transported. Instead of nitrogen, dried compressed air can be used as the carrier gas for transportation.

If the ferro-silicon has to be conveyed for a longer distance, then it can be transferred from the storage bunker 9 into a tank truck with proper sealing. The powder can then be conveyed in the tank truck to the silo 11 and transferred by appropriate by means which can be gravity feed or pneumatic conveyor.

The system for injection of the ferro-silicon powder comprises a dispenser 12 to which powder is charged from silo 11 through air cylinder valve 102. The dispenser can, for example, have an inner volume of 3.8 cubic meters. The dispenser is supported on a weighing device 13 which can be a load cell type with three load cells. This can transfer the appropriate signal to a central location or pulpit where the operator is located and where he can observe the weight of ferro-silicon powder passed to the dispenser from a digital indicator.

The dispenser 12 is provided with an exit air cylinder controlled valve 101 and the pressure in the vessel P1 is adjusted by gas stream (usually nitrogen) A at a pressure of, for example, 6–7 $Kg/Cm^2$. The nitrogen flow is controlled by a differential pressure recording controller 201 operating through a control valve 202.

The exit line 51 from the dispenser after valve 101 passes into a gas conveyor line 52 in which flow is controlled by valves 103 and 104 fed respectively by gas pressures B and C at respectively 6 to 7 $Kg/Cm^2$ and 4 to 5.5 $Kg/Cm^2$. Pressure in the line 52 prior to line 51 is $P_2$. Lines 51 and 52 combine in line 53 leading to lance 20. The amount of ferro-silicon to be released from the dispenser 12 can be set in a central control point. Pressure within the dispenser is established to a preset point for example at 3.0 $Kg/Cm^2$. The lance 20 descends into the molten iron in torpedo car 19 and as the lance descends, valves 103 and 104 open automatically to supply nitrogen into the injection line. Nitrogen through valve 104 is provided to prevent slag or molten iron entering into the lance. As the lance descends into the molten iron and passes through a predetermined point controlled by a timer, valve 101 opens and valve 104 closes slowly. Thus ferro-silicon commences to pass from the dispenser into line 51. As the ferro-silicon powder descends through line 51 into line 52, it combines with the stream of nitrogen coming through valve 103 to be conveyed to the injection line into the molten iron.

After operation of the injection ferro silicon powder has been completed then desulfurization agent can be added in the desired amount by an analagous operation.

All of the operations can be performed from a central control point or pulpit excepting for the actual inclination of lance and driving the lance car which can be operated from a control panel mounted on the lance car.

The rate of injection of the ferros-silicon powder measured in Kg/min. is mainly controlled by the differential pressures P1 in the dispenser and P2 in the line 52. This differential pressure can be measured in the central control point at a differential pressure recording controller 201. The size of the discharge nozzle of the diepenser will also effect the injection speed, but usually the size is fixed after a trial operation.

Figure 2:
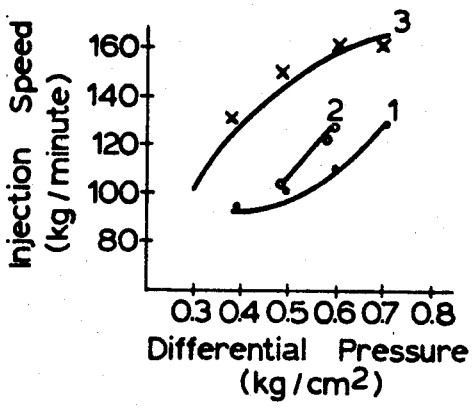
FIG. 2 is a graphical relationship between the rate of injection and the differential pressure of two nitrogen streams used to drive the pneumatic system.

In FIG. 2, the relationship between the differential pressure and injection speed is shown graphically. In the Figure:

1. is an injection of desulfurization agent, discharged nozzle of dispenser 17Ø;
2. is an injection of ferro-silicon powder, the discharge nozzle of dispenser 15Ø;
3. is an injection with ferro-silicon powder, the discharge nozzle of dispenser is 17Ø.

The injection speed can also be affected by nitrogen ratio which is the required amount of nitrogen to transport one kilogram of ferro-silicon powder, i.e. Nl/Kg Fe-Si (Nl is a Normal liter).

Figure 3:
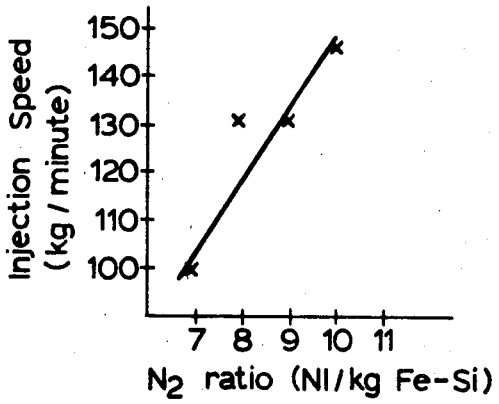
FIG. 3 is a graphical relationship between the nitrogen ratio and injection speed.

Th correlation of the nitrogen ratio to the injection speed is shown in FIG. 3.

The flow rate of conveying nitrogen and the differential pressure of the dispenser (P1) and in the conveyor line 52 (P2) can be controlled by a differential pressure recording controller 201 and a flow ratio recording controller 301. By proper control of these two operating valves, steady operation will be achieved. Normally the discharge nozzle of the dispenser will be 15Ø or 17Ø. If the differential pressure dispenser is set at 0.3–0.7 $Kg/Cm^2$ and the nitrogen ratio is maintained at 7–10 Nl/Kg Fe-Si then steady operation will be achieved and injection will take place at from 100–160 Kg/min.

Generally an injection pressure of 2.5–4.5 $Kg/Cm^2$ is appropriate although the pressure will be determined by the depth of the lance dipped into the molten iron; any pressure drop in the pipe lines must take into account including the possibility of clogging of the pipeline with powder.

A typical angle of the lance during injection is 70°. The temperature of gas coming out of the iron i.e. waste gas is usually under 50° C. and the temperature drop of molten iron during the injection will be within 10° C. It has been found that the amplitude of vibration of the torpedo car during the operation is under 5 mm and the lance life is more than 3 treatments.

In practical operation, it has been found that a silicon yield of more than 80% is achieved.

The injection time will depend on the rate of addition and to the difference between the silicon content of molten iron originally and the desired silicon content. In a typical example a torpedo car contains 200 metric tons of molten iron can have a silicon content of 0.6% by weight. To increase the silicon content up to 2.0% by weight, it will require ferro-silicon: $(2.0-0.6)\% \times 200 \times 10^3$ Kg - (silicon purity in ferro - silicon powder) $\div$ 0.85 (yield) $\approx$ 4570 Kg.

The injection time: 4570 Kg $\div$ 150 Kg/min (injection speed) $\approx$ 30 minutes.

Subsequent to the ferro-silicon injection, gas injection can continue for a few minutes. This gives additional agitation which assists in homogeneous dispersion of the silicon in the molten iron.

Desulfurization treatment after addition of ferro-silicon can be one or more treatments in order to obtain a pig iron with low sulfur content. Typical desulfurization agents can be a mixture of calcium carbide ($CaC_2$), slaked lime ($Ca(OH)_2$) and powdered cokes.

Using such treatments a sulfur content can be lowered to less than 0.005% by weight. A desulfurization treatment after silicon injection generates CO and $H_2$ which result in a strong stirring action in the molten iron. This is assists in homogeneous dispersion of the silicon in the iron.

After a silicon injection with or without further desulfurization treatment, the molten iron, for example, in the torpedo car can be transferred to a pig casting machine to form pig iron. During casting of the pig iron, samples can be taken at intervals for example 1 testing per 20 metric tons for chemical analysis. From these tests, typical results obtained were as follows:

| Treating times | Operation Mode | Desired Silicon Content | Average Silicon Content | Standard deviation |
|---|---|---|---|---|
| 1. | Only silicon injection treatment | 1.9% | 1.82% | 0.05% |
| 2. | Same as 1. | 1.3% | 1.24% | 0.13% |
| 3. | After silicon injection blowing $N_2$ into molten iron continuously for 4 minutes | 1.9% | 1.87% | 0.02% |
| 4. | After silicon injection a subsequent desulfurization treatment | 1.3% | 1.26% | 0.03% |
| 5. | Same as 4. | 1.3% | 1.27% | 0.02% |

As illustrated in the above table, the standard deviations in the last column indicate that homogenous pig iron can be achieved either by the continuous nitrogen blowing for a period after the silicon injection or by successive desulfurization treatment after the silicon injection.

We claim:

1. A process for the addition of ferro-silicon to molten iron to increase the silicon content which comprises conveying pulverized ferro-silicon powder from a container which is at a preset pressure $P_1$ to a conveyor line in which line gas flow is controlled by at least two valves set to open at predetermined gas pressures to establish gas pressure $P_2$ in said line and further conveying said ferro-silicon through an adjustable lance into the molten iron, the rate of injection of the ferro-silicon being controlled by the difference in pressures $P_1$ and $P_2$ by a differential pressure recording controller.

2. A process according to claim 1 in which the pulverized ferro-silicon powder is added to a stream of carrier gas and the carrier gas is injected into the molten iron.

3. A process according to claim 2 in which the carrier gas is selected from the group consisting of nitrogen, dried compressed air, argon, carbon dioxide and a mixture of one or more of said gases.

4. A process according to claim 1 in which a ferro-silicon containing from 50 to 80% silicon is pulverized to a particle size of under 3 mm.

5. A process according to claim 4 in which a ferro-silicon is employed with a silicon content of 72% by weight and is injected into the molten iron in an amount of from 1.46 Kg to 1.74 Kg per metric ton of molten iron thereby to increase the silicon content by 0.1%.

6. A process according to claim 1 in which the molten iron is contained in a ladle.

7. A process according to claim 6 in which the ladle is a torpedo ladle.

8. A process according to claim 1 in which the injection takes place at a point located between a blast furnace and a steel making shop.

9. A process according to claim 2 in which the ferro-silicon is injected in the gas stream and there is then a period of injection of gas to complete homogenous distribution of the silicon in the molten iron.

10. A process according to claim 2 wherein, after injection of the ferro-silicon powder is complete, a desulfurization agent is injected by means of a gas stream.

* * * * *